United States Patent [19]

Blackwell et al.

[11] Patent Number: 4,848,459

[45] Date of Patent: Jul. 18, 1989

[54] APPARATUS FOR INSTALLING A LINER WITHIN A WELL BORE

[75] Inventors: Henry W. Blackwell, Venus, Tex.; Clifford L. Talley, Hobbs, N. Mex.; Rodger D. Lacy, Midland, Tex.

[73] Assignee: Dresser Industries, Inc., Dallas, Tex.

[21] Appl. No.: 180,778

[22] Filed: Apr. 12, 1988

[51] Int. Cl.[4] ..... E21B 23/06; E21B 33/129; E21B 33/14

[52] U.S. Cl. ..... 166/142; 166/124; 166/126; 166/139; 166/285; 166/387

[58] Field of Search ..... 166/142, 143, 123, 124, 166/126, 138, 139, 181, 285, 387

[56] References Cited

U.S. PATENT DOCUMENTS

| | | | |
|---|---|---|---|
| 2,291,371 | 7/1942 | Buchanan et al. | 166/290 |
| 2,862,563 | 12/1958 | Thompson | 166/204 |
| 2,877,850 | 3/1959 | Burns | 166/208 X |
| 3,152,643 | 10/1964 | Burns | 166/208 X |
| 3,158,201 | 11/1964 | Springer | 166/208 X |
| 3,223,159 | 12/1965 | Brown | 166/290 |
| 3,253,655 | 5/1966 | Brown | 166/290 X |
| 3,818,986 | 6/1974 | Abney et al. | 166/143 X |
| 3,863,719 | 2/1975 | Parker | 166/305 |
| 3,913,675 | 10/1975 | Smyrl | 166/278 |
| 3,926,409 | 12/1975 | Abney et al. | 251/344 |
| 3,934,652 | 1/1976 | Cochran | 166/285 |
| 3,952,804 | 4/1976 | Smyrl | 166/278 |
| 3,960,366 | 6/1976 | Abney et al. | 251/341 |
| 4,030,546 | 6/1977 | Rogers et al. | 166/208 |
| 4,060,131 | 11/1977 | Kenneday et al. | 166/125 X |
| 4,340,116 | 7/1982 | Weise | 166/215 |
| 4,349,071 | 9/1982 | Fish | 166/124 |
| 4,428,428 | 1/1984 | Smyrl et al. | 166/278 |

*Primary Examiner*—Stephen J. Novosad

*Attorney, Agent, or Firm*—Edward G. Fiorito; William R. Peoples; Roy L. Van Winkle

[57] ABSTRACT

A packer setting tool, a packer assembly and an attached liner assembly are lowered into a well bore at a desired depth to fix the liner therein. Cement is pumped down a tubing string, through the packer, the lining, check valves and forced upwardly in the annulus of the well bore. The pumped cement is followed by a non-setting liquid to clear the internal tubular structure. The packer assembly is then set in the wet cement of the annulus to provide an additional fluid seal in the well bore. The packer setting tool is released and the cement is allowed to harden and fix the linear and the packer assembly within the well bore.

3 Claims, 7 Drawing Sheets

APPARATUS FOR INSTALLING A LINER WITHIN A WELL BORE

RELATED APPLICATION

"Setting Tool for Mechanical Packer," by Blackwell, et al., Ser. No. 180,488, filed concurrently herewith.

TECHNICAL FIELD OF THE INVENTION

The present invention relates in general to well casing packers, and more particularly to apparatus and methods for setting such packers and associated liners within a well bore.

BACKGROUND OF THE INVENTION

Packers are commonly employed for isolating sections of a perforated well casing adjacent oil producing formations. By isolating sections of a well casing between hydrocarbon producing formations, other depleted formations can be separated therefrom. Packers are also utilized to isolate sections of well casings to enable injection of fluids into selected formations, while isolating other formations.

Currently available casing packers typically include a tubular section with an elastomeric boot disposed thereabout so that when radially expanded, a seal is effected within the casing. A packer is thus effective to isolate a casing into separate sections. The packer itself is generally fixed within the casing by employing a number of toothed slip members which are wedged between the packer tubular section and the well casing. An upper and lower set of slips are generally utilized, one having teeth oriented to prevent downward movement of the packer, and the other having teeth oriented in another direction to prevent upward movement of the packer.

Well casing packers are constructed for setting, or otherwise being fixed in a well casing by various techniques. For example, certain packers, known as "wire-line packers", are set by way of an electric wire-line which extends from the packer apparatus to the surface. By energizing the wire-line, a power charge is ignited and the packer is tripped so that the slips engage the casing, thereby setting the packer. Because of the general construction of such type of packers, only a modest amount of equipment can be supported therefrom as the packer is lowered within the well bore. Normally, a wire-line packer can support about 2,500 pounds of equipment suspended therefrom.

Hydraulic packers are available which are set with the use of pressurized hydraulic fluid. Some types of hydraulic packers can even be released by pumping a different fluid pressure downhole to the packer assembly. The disadvantage with the wire-line and the hydraulic type of packers is that expensive surface equipment is required. Particularly, electric wire-line dispensing trucks and heavy duty hydraulic pumping equipment are required to operate these packer assemblies.

Permanent, mechanical or drillable packers are another type of packer equipment which are set and permanently fixed within a casing. The drillable packers require additional downhole apparatus for setting the slips within the casing, but can support several hundred thousand pounds of equipment therefrom.

It can be appreciated that the operation of packers must be extremely reliable, otherwise the retrieval thereof from a casing several thousand feet deep may be extremely time consuming and expensive. In setting a mechanical packer, a drill string is often utilized in the setting process and disconnected therefrom and removed from the well bore thereafter. When a packer is utilized in conjunction with a well casing cementing operation, it is imperative that the drill string be completely disconnected from the packer, otherwise the entire drill string would be fixed within the well bore when the cement sets.

Packers can also be utilized in conjunction with well bore liners for cementing an isolated part of a casing. However, a problem of great concern in such an operation is the withdrawal of the packer setting equipment before the cement sets. As noted, any delay in removing the packer setting equipment may result in its being fixed by the cement within the casing. As a result of the risk of inadvertently cementing the drill string equipment within a well bore, packers are not widely used, if at all, in conjunction with cementing operations.

From the foregoing, it can be seen that a need exists for improved packer setting apparatus which can reliably set a mechanical packer within a casing, and be quickly and reliably released therefrom. An associated need exists for a technique in which a packer can be set and released without resorting to surface equipment which otherwise would not be required. Yet another need exists for a technique for fixing a packer and a liner within a well bore to achieve an improved seal when the combination is cemented within the well bore.

SUMMARY OF THE INVENTION

In accordance with the invention, there is disclosed a drillable packer construction which substantially reduces or eliminates the shortcomings and disadvantages of the prior art packers. The drillable packer of the invention is constructed so that various rotational and axial movements of the drill string are effective to set the packer and deploy an elastomer into a sealing relationship with the casing, as well as release the drill string from the packer.

Disclosed also is a method and apparatus for isolating a zone of a well casing with a packer and attached liner, and introducing cement into a well bore area, and then quickly removing the packer setting apparatus to thereby allow the cement to solidify around the packer and liner. The packer affords an improved and additional seal to the casing, especially in view of the normal shrinkage of the cement when curing.

In accordance with the preferred embodiment of the invention, a drill string setting tool is releasably connected to a packer assembly and attached liner so that the entire unit can be lowered in the casing to the proper depth. Friction springs are fastened to the packer setting tool for centering it as it is lowered in the casing, as well as to prevent rotation of a spring anchor cage and slip-cover sleeve during setting of the packer. The drill string is then rotated, wherein the threaded slip-cover sleeve moves axially upwardly and allows a number of upper toothed slips to be released into engagement with the casing. The drill string and attached packer setting tool are then lifted upwardly an amount sufficient to wedge the upper slips, as well as wedge a number of lower toothed slips into gripping engagement with the casing. The upward movement of the drill string and attached setting tool also expands an elastomeric boot to effect a seal of the packer assembly to the casing. A ratcheting arrangement maintains the packer slips wedged to the casing, as well as maintains the sealing boot expanded against the casing. The packer is then tightly and permanently wedged within the casing and resists any movement thereof.

Next, the drill string is rotated again, whereupon a shearable connection between the setting tool and the packer assembly is released, thereby allowing the setting tool to be quickly and efficiently withdrawn from the casing.

In the preferred form of the invention, a packer assembly slip-cover sleeve is threadably engageable with a threaded ring which rotates in response to the rotation of the drill string. On a number of rotations, the slip-cover sleeve moves sufficiently axially such that the upper slips are released, even though the threaded engagement between the threaded ring and the cover sleeve may remain intact. To that end, the cover sleeve includes a number of longitudinal slits in the sidewall thereof to allow slight radial yield or deformation. Hence, an upward pull on the drill string and attached packer setting tool is effective to disengage the few engaged threads by the slight outward deformation of the cover sleeve sidewall. The complete and reliable separation of the packer and setting tool is thereby ensured.

The packer of the invention can be advantageously employed in casing cementing operations where the reliable release of the setting tool is mandatory. In such an operation, a liner assembly is attached to the bottom of the packer assembly. The liner assembly includes a seal bore extension, a swivel, a liner, a tubing seal and one or more check valves. The packer and attached liner assembly of the invention can be cemented in place by a cement mixture which is introduced into a central conduit extending through the packer assembly. The cement is also forced through the liner assembly where it fills the bottom of the well bore and then moves upwardly in the annulus between the the packer and liner assemblies and the well bore. Next, the packer assembly is set in the cement by the procedure noted above, and the setting tool released therefrom, all before the cement has begun to solidify. After removal of the setting tool, the cement solidifies to thereby fix the packer assembly in the casing, together with the liner which lines an uncased bottom portion of the well bore.

BRIEF DESCRIPTION OF THE DRAWINGS

Further features and advantages will become more apparent from the following and more particular description of the preferred embodiment of the invention, as illustrated in the accompanying drawings in which like reference characters generally refer to the same or similar parts through the views, and in which.

DETAILED DESCRIPTION OF THE INVENTION

Figure 1:
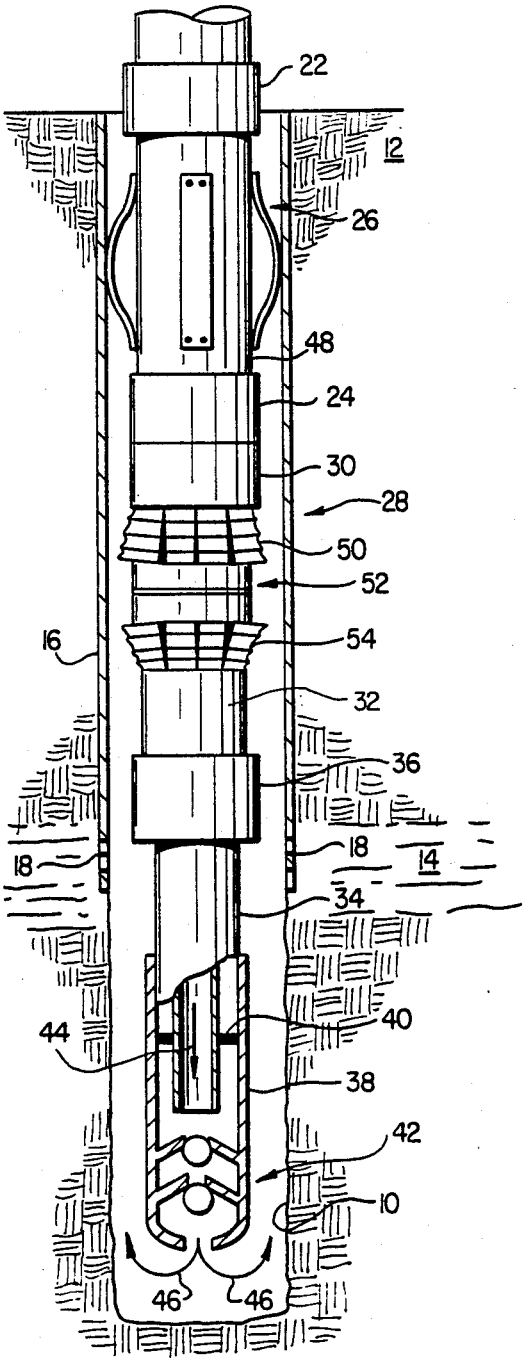
FIG. 1 is a side elevational view of a partially cased well bore having situated therein the packer assembly and liner assembly of the invention, as utilized in a cementing operation.

FIG. 1 illustrates an application in which the invention may be advantageously practiced. However, it should be appreciated that the invention may be readily adapted by those skilled in the art for use in many other applications.

Illustrated is a well bore 10 drilled within the earth's crust 12 through a hydrocarbon producing formation 14. The bore hole 10 is preferably lined, at least partially, with a casing 16 for providing integrity to the well bore and preventing it from caving in or otherwise deteriorating. The casing 16 may be perforated 18 at vertical locations aligned with the hydrocarbon producing formation 14. As can be appreciated, such a hydrocarbon formation 14 may be located many thousands of feet below the surface of the earth.

In order to install a packer within the casing 16, such apparatus must be lowered to the appropriate depth within the casing 16 by plural sections of drill pipe, a bottom section shown as reference character 20. A coupling 22 provides a threaded connection between the lowermost drill pipe 20 of the drill string and a packer setting tool 24. The packer apparatus includes, among other elements, a friction spring and cage apparatus 26, a packer assembly 28 itself, and a packer releasing tool 30. As noted above, the drillable or mechanical packer, when set within the casing 16, can support a large load comprising other production or fluid injection apparatus. In the cementing operation, a seal bore extension 32 is connected to the bottom of the packer equipment. The seal bore extension 32 is connected to a fiberglass tubing liner 34 through a swivel coupling 36. A bottom seal bore 38 is fixed to the fiberglass liner 34, and includes a cement tubing seal 40. A pair of check valves 42 are provided as the bottommost elements to prevent cement or other fluids from reversing direction, once pumped downhole. Two check valves are provided for purposes of redundancy to improve the reliability of the cementing operation.

The general function of the invention is briefly described as follows. Once the fiberglass lining apparatus, the packer and the setting tool have been assembled at the surface, the unit is lowered into the casing 16 by the drill string 20 to the desired depth. Cement, or another solidifying material, is then pumped down the drill string 20 through the packer assembly 28 and the check valves 42, as shown by arrows 44. As noted, the check valves 42 prevent the up-flow of the cement once it is pumped into the annulus area surrounding the check valves. The cement flows upwardly in the annulus of the well bore, as noted by arrows 46. A predetermined volume of cement is pumped down the drill string 20, followed by water, so that the cement rises in the annulus to the point above the packer assembly 28.

Shortly after the cement has been pumped downhole by the surface equipment, the drill string 20 is rotated, which also rotates a packer setting stem 48. Due to the engagement of the friction springs 26 with the casing 16, the springs and the associated spring cage do not rotate. However, by rotating the drill string 20, an upper set of toothed slips 50 is released, and fall outwardly and into engagement with the inside surface of the casing 16. Once the upper slips 50 have been deployed, the drill string 20 is raised a certain distance. The raising of the drill string 20 raises a bottom portion of the packer assembly 28 for deploying an elastomeric boot 52 to effect a seal to the internal sidewalls of the casing 16. In response to the raising of the drill string 20, a bottom set of toothed slips 54 is also deployed into a gripping relationship with the casing 16. The elastomeric boot 52 displaces a portion of the cement to achieve a high quality seal with the casing 16. Simultaneous with the deployment of the elastomeric boot 52, a wedge mechanism on the packer wedges the upper slips 50 into permanent engagement with the casing 16, as is the case with the bottom set of slips 54. The packer assembly 28 is thereby permanently fixed within the casing 16. Due to the firm engagement of the toothed upper and lower slips 50 and 54 with the casing 16, several hundred thousand pounds of equipment can be suspended by the packer assembly 28 within the casing 16.

Once the packer is set in the casing 16 as noted above, the packer assembly 28 cannot be rotated. However, according to a technical advantage of the invention, the packer assembly 28 includes a quick release mechanism 30 which is responsive to a subsequent rotation of the drill string 20 for releasing the setting tool 24 from the packer assembly 28. Once the drill string 20 has been rotated a second time, a connection between the setting tool 24 and the packer assembly 28 is sheared, whereupon the drill string 20, the setting tool 24 and the friction spring and cage apparatus 26 can be removed from the casing 16. The packer setting operation, and its release from the setting tool 24, can be accomplished in a matter of minutes before the cement begins to set.

As noted above, a non-solidifying liquid is pumped down the drill string 20 to force the liquefied cement yet remaining centrally within the packer assembly 28 and fiberglass liner 34 out into the annulus of the well bore 10 to an elevation above the packer assembly 28, and back toward the surface. As a result, the internal bore of both the packer assembly 28 and liner 34 is cleaned, and the cement is allowed to set and harden in the well bore annulus. Subsequent to the foregoing, bore hole firing apparatus can be lowered into the area of the fiberglass liner 34 for reopening lateral areas to access the hydrocarbon producing formation, such as illustrated by reference character 14. From the foregoing, it can be appreciated that a reliable and expedient disconnect of the packer assembly 28 is required to prevent the entire drill string from being captured many thousands of feet downhole. As noted above, if such an event occurred, expensive and time-consuming efforts would need to be undertaken to cut the drill string at the packer location, clean out the well bore, and commence activities.

Having described the general construction and operation of the invention, reference is now made to FIGS. 2*a*–2*d* where there are shown the details of the packer setting tool 24 and the packer assembly 28. The drill string 20 is coupled, via the coupling 22 to the packer setting tool stem 48. Surrounding the upper portion of the setting tool stem 48 are a number of friction springs 60 which are adapted to bow outwardly in engagement with the casing 16. The friction springs 60 are fixed at one end thereof by screws 62 to an anchor cage 64. The other end of the friction springs 60 are captured within slots 66 of the anchor cage 64 for enabling the springs 60 to frictionally conform to the internal surface of the casing 16. The anchor cage 64 is threadably connected to a slip-cover sleeve 68 which surrounds the lower portion of the setting tool stem 48. With such a construction, the rotational movement of the drill string 20 does not rotate the slip-cover sleeve 68. The slip-cover sleeve 68 includes on an internal surface thereof a number of right-hand threads 70. Formed through the sidewalls of the slip-cover sleeve 68 are a number of slits 72 for allowing slight radial deformation of the sleeve 68. The slip-cover sleeve 68 is threadably connected to a threaded ring 74 which is carried by the tubular body of a packer mandrel 76. The packer mandrel 76 generally defines a tubular body for providing a structure to support a number of the elements or components arranged therearound. Housed within the tubular mandrel 76, and threadably attached to the bottom of the setting tool stem 48, is a tubular central conduit 77 which provides a fluid carrying conduit through the packer assembly 28. The central conduit 77 extends downwardly through the liner 34 and is sealed therearound within the lower seal bore 38. When the liquified cement is pumped down the drill string 20, such material passes through the packer assembly 28 and the conduit 77 without hampering the operation of the packer setting and releasing functions.

Figure 3:
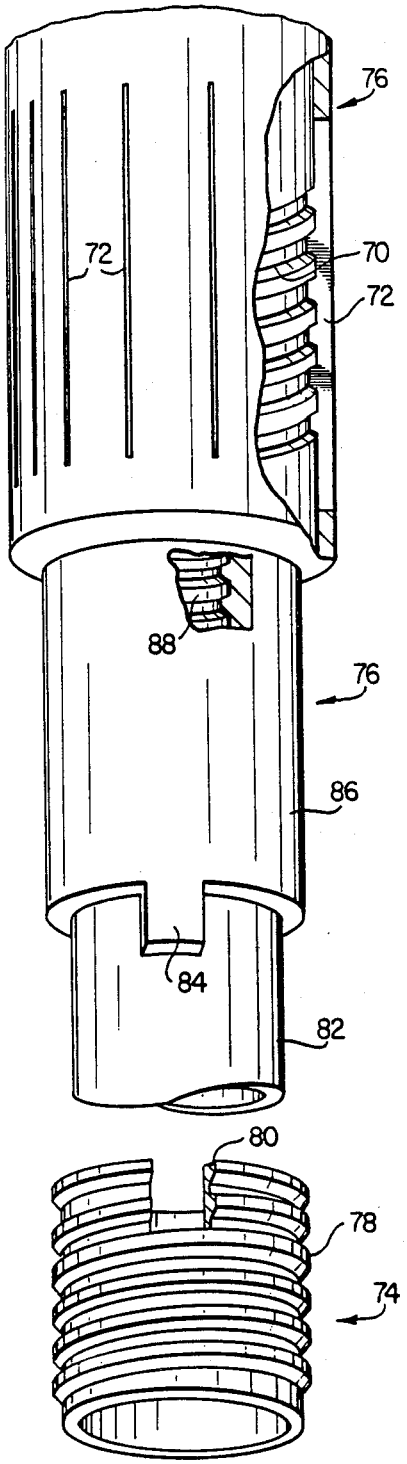
FIG. 3 is an exploded view of several parts of the packer assembly operative to achieve a quick and efficient release of setting tool therefrom.

The engaging relationship between the packer mandrel 76 and the threaded ring 74 is shown in more detail in FIG. 3. The threaded ring 74 includes a number of external threads 78 which are generally not square, but rather have slightly tapered edges, for a purpose to be described below. Further, the threaded ring 74 includes a key or lug notch 80 formed or otherwise milled into an upper edge thereof. The threaded ring 74 freely rotates on a reduced diameter portion 82 of the packer mandrel 76, except when the notch 80 is engaged with a corresponding sized lug 84 machined from an increased diameter part 86 of the packer mandrel 76. Hence, when the ring 74 is locked to the packer mandrel 76, via the lug 84 and the notch 80, the ring 74 is carried with the mandrel 76 during rotation of the drill string 20. The upper part of the mandrel 76 has internal threads 88, of left-hand orientation.

The threaded part of the mandrel is threadably engaged by a coupling 90 (FIG. 2*c*) to the packer setting stem 48. The threaded connection between the packer setting stem 48 and the coupling 90 is by right-hand threads 92. Moreover, the left-hand threaded connection between the coupling 90 and the tubular mandrel body 76 is shearably fixed by one or more brass shear screws 94. The shear screws 94 mechanically fix the coupling 90 to the mandrel 76 until the requisite shear force is achieved, whereupon the stem 48 and associated coupling 90 can be separated from the packer assembly 28 by the right-hand rotation of the drill string 20.

With reference again to FIG. 2*c*, a mandrel ratchet mechanism 96 is arranged around the reduced diameter portion 82 of the mandrel body 76. The outer surface of the reduced diameter part 82 of the mandrel body 76 includes a number of downwardly oriented teeth 98 encircling the mandrel 76. A first ratchet ring 100, of the split type, includes on an internal surface thereof upwardly oriented teeth 102 for engaging the mandrel body teeth 98. On an outer surface of the first ratchet ring 100 are other upwardly directed teeth 104. A second ratchet ring 106 has on its inner surface thereof, downwardly directed teeth 108 for engaging the outer teeth 104 of the first ratchet ring 100. The outer surface of the second ratchet ring 106 is smooth and fits inside of an internal cylindrical surface of the slip-cover sleeve 68.

Formed further down on the tubular mandrel body 76 is an external annular groove 110 in which an upper protruding portion of a plurality of upper toothed slips 50 are seated. Each slip 50 includes an inwardly directed protrusion 114 which fits within the mandrel annular groove 110 so that such slip 50 cannot move downwardly when confined around the outer surface of the tubular mandrel body 76. As noted, and after initial assembly of the packer assembly 28, the slip-cover sleeve 68 covers at least a portion of the slips 50 to keep such slips arranged closely around the mandrel body 76 and prevent them from being inadvertently deployed. This prevents the packer assembly 28 from being inadvertently engaged with the casing 16. In addition, a continuous O-ring 116 encircles the slips 50 to maintain such slips generally arranged in an ordered manner around the packer assembly 28, especially when initially released for gripping engagement to the casing 16.

The outer surface of the mandrel body 76 also includes downwardly oriented annular teeth 118 to maintain engagement of the slips 50 to the packer when subsequently set and fixed to the casing 16. Fixed directly below the upper slips 50 to the mandrel body 76, by a shearable screw connection 120, is an upper head 122 with an upper angled surface 124. The head 122 is effective, when shearably released from the mandrel body 76, to move upwardly and wedge the upper slips 50 into a firm and reliable grip to the casing 16. As noted by the orientation of the teeth of the slip 50, upward movement of the packer assembly is prevented when set within the casing 16.

A pair of annular expansion rings 126 and 128 are held together by a tongue-and-groove connection, and function to separate the upper annular head 122 from an elastomeric boot 52 situated therebelow. The upper edge of the boot 52 includes an annular angled element 132 which fits under the expansion ring 128. With such an arrangement, the upper edge of the elastomeric boot 52 is maintained engaged around the tubular mandrel body 76 during axial compression to effect deployment of the boot 52. The elastomeric boot 52, when deployed, expands outwardly to provide a seal between the packer mandrel body 76 and the inside surface of the casing 16. A metal constriction band 134 encircles the elastomeric boot 52 and prevents a central circumferential portion thereof from expanding outwardly. Thus, when axially constricted, the rubber boot 52 deploys outwardly at two sections, one above the constriction ring 134, and one below the constriction ring 134.

The lower end of the elastomeric boot 52 is maintained engaged around the tubular mandrel body 76 by a similar set of expansion rings 136. A lower head 138 is fixed around the mandrel body 76 by one or more shear screws 140. The lower end of the head 138 includes a beveled surface 142 which is slideable under a lower set of slips 54 for wedging such lower slips in a firm gripping engagement with the inside surface of the casing 16. The lower slips 54 have teeth 146 angled downwardly to prevent the packer assembly 28 from being pulled downwardly, once such assembly is set within the casing 16. A breakable metal band 148 maintains the plural lower slips 54 generally arranged around the tubular mandrel body 76, but is broken during deployment.

The lower end of the tubular mandrel body 76 is threadably connected to a nipple 150. In addition, a number of set screws 152 prevent inadvertent rotation of the nipple 150 with respect to the tubular mandrel body 76. An O-ring 154 provides a fluid seal between the tubular mandrel body 76 and the nipple 150. The nipple 150 includes an upper shoulder surface 156 on which the bottom set of slips 54 rest.

Once lowered to the proper depth in the casing 16, the deployment of the lower slips 54, the elastomeric boot 52 and the upper slips 50 is accomplished as follows. The drill string 20 is pulled or raised upwardly, thereby carrying with it the setting tool stem 48, the coupling 90 and the tubular mandrel body 76. As a result, the nipple 150 is also moved upwardly which shears the upper head screw 120 and breaks the lower slip band 148. The upper slips 50 are then forced against the casing 16 by the upper head 122 and firmly set. The lower slips 54 are forced upwardly onto the ramped edge 142 of the lower head 138. This, in turn, forces the lower head upwardly which shears the screws 140, and which then forces the elastomeric boot 52 upwardly also. The upward movement of the elastomeric boot 52 maintains a force on the upper head 122. Of course, before deployment of the noted elements, the upper slips 50 have been released, i.e., are no longer engaged around the tubular mandrel body 76 by the slip-cover sleeve 68. With the continued upward movement of the nipple 150, the upper and lower slips 50 and 54 are forced outwardly into a firm gripping relationship with the casing 16. The general axial force applied between the ends of the elastomeric boot 52 causes it to bow outwardly on each side of the constriction band 134. The elastomeric boot 52 expands outwardly sufficiently such that it presses against the internal sidewalls of casing 16, thereby effecting a seal to the casing 16 and defining isolated upper and lower zones within the casing 16. When sealed, fluid is able to be pumped through the packer assembly 28 via the central conduit 77. When the packer is set in the noted manner, it cannot be moved upwardly or downwardly, or rotated.

Figure 2A:
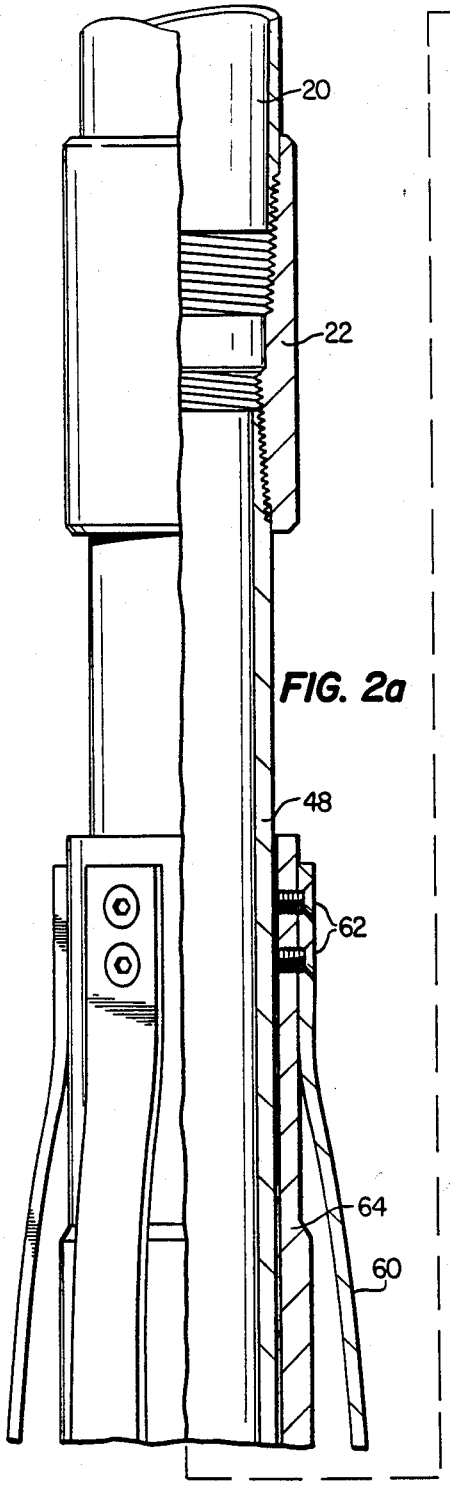
FIGS. 2*a*–2*c*, joined together, are partial sectional views packer and setting apparatus according to the preferred form of the invention.
Figure 2B:
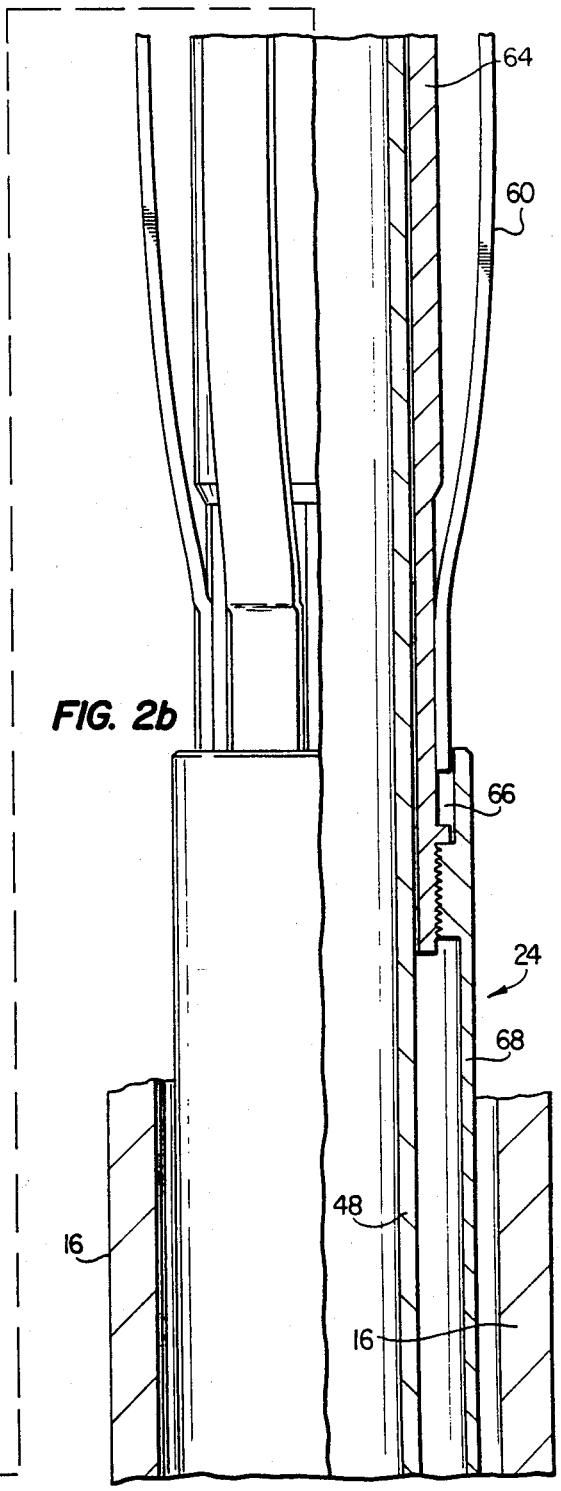
Figure 2C:
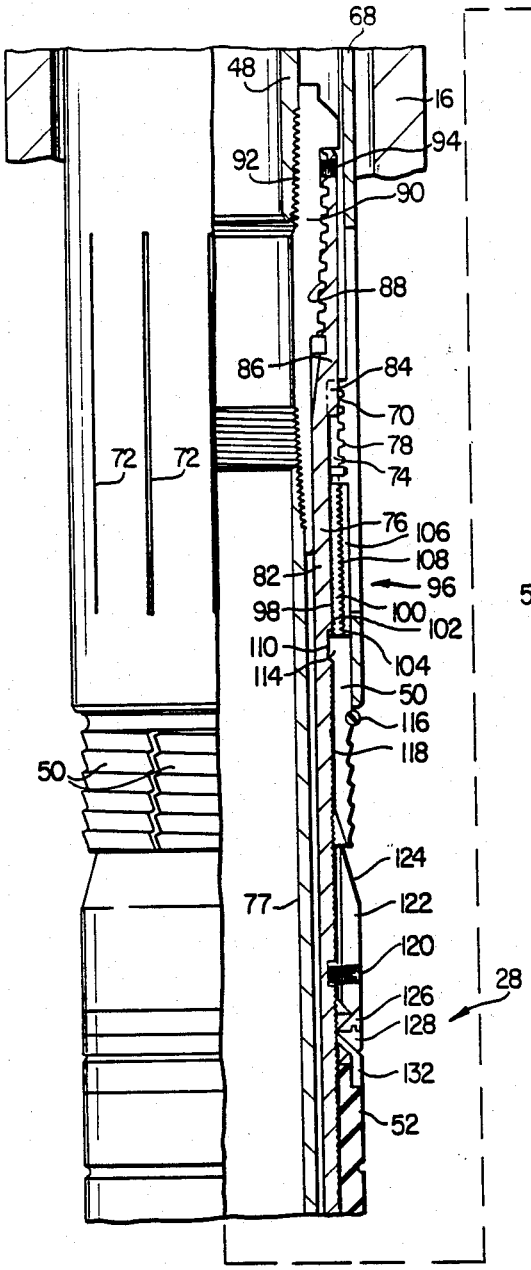
Figure 2D:
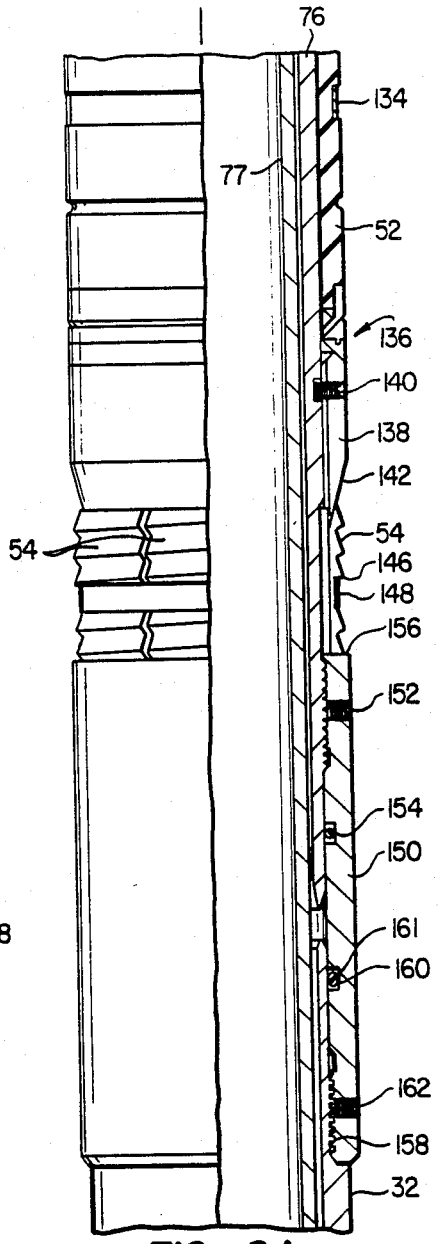

The nipple 150 includes internal threads 158 for attaching other equipment thereto, such as the seal bore extension 32 (FIG. 2*d*). An internal annular groove 160 is provided for receiving an O-ring 161 for sealing such other equipment therein. Optional set screws 162 may be utilized in the threaded hole for fixing the lower situated equipment to the packer assembly 28.

In the preferred operation of the invention, the packer setting apparatus, the packer assembly and the liner installing assembly are utilized in conjunction with the cementing operation noted above. In such an application, the packer can be set, and the setting tool removed therefrom, by the operations described below. First, the packer setting tool 24 and the packer assembly 28 are lowered to the proper depth within the casing 16, via the drill string 20. The friction springs 60 are constructed to exert a force on the sidewalls of the casing 16 sufficient to require a force of about 400–500 pounds to move the packer assembly 28 within the casing 16. Importantly, the friction springs 60 grip the inside of the casing 16 and thus resist attempts to rotate the anchor cage 64 and the slip-cover sleeve 68.

Once the packer assembly 28 is located at the proper depth within the casing 16, a specified volume of cement is pumped down the drill string 20, followed by water, through the packer assembly 28 and the liner assembly 23 into the well bore annulus. The details of the cementing operation are described in more detail below in connection with the liner assembly 34. Next, the drill string 20 is rotated in a right-hand direction, which angular movement rotates the setting tool stem 48. The rotational movement of the setting tool stem 48 is translated through the coupling 90 to the tubular mandrel body 76 which is fixed thereto by the set screw 94. The right-hand rotation of the drill string 20 is in a direction which tightens the right-hand threads 92. No relative movement occurs with respect to the left-hand threads 88, as the tubular mandrel body 76 is fixed to the coupling 90 via the shearable set screw 94. Insufficient force is exerted on the set screw 94, at this time, for any shearing action to occur.

The rotational movement of drill string 20, and thus the tubular mandrel body 76, causes corresponding rotation of the threaded ring 74, due to its engagement by way of the notch 80 and the key lug 84. Accordingly, the rotation of the threaded ring 74 causes a coaction between its threads 78 and those 70 of the slip-cover sleeve 68. The slip-cover sleeve 68, the attached anchor cage 64 and friction springs 60 do not rotate and thus move upwardly with respect to the tubular mandrel body 76. After a number of rotations of the drill string 20, the slip-cover sleeve 68 is moved upwardly sufficiently such that the bottom portion thereof uncovers the upper slips 50. Preferably, the slip-cover sleeve 68 is moved upwardly sufficiently to become completely disengaged from its threaded connection with the threaded ring 74. However, if such a complete disconnection is not effective during the initial rotation of the drill string, the parts are separated by a subsequent action described below.

Once the upper slips 50 are deployed, they fall downwardly into engagement with the casing 16. The next action in setting the packer equipment of the invention is the upward movement of the drill string 20, thereby also moving the tubular mandrel body 76 upwardly. The bottom nipple 150 is carried by the mandrel body 76 and forces the lower slips 54 upwardly also. As noted above, the deployment of the lower slips 54 and the elastomeric boot 52 is achieved by the upward movement of the lower nipple 150. Because the upper slips 50 cannot move upwardly, primarily due to the engagement thereof with the casing 16, the intermediate components are forced together. The lower slips 54 are thereby wedged by the lower head 138 within the cement into gripping engagement with the casing 16, as are the upper slips 50 as a result of the wedging action with the upper head 122. As noted above, the axial constriction also deploys the elastomeric boot 52 outwardly within the cement into a sealing relationship with the casing 16. The packer apparatus is thereby permanently set within the cemented casing 16 with the elastomeric boot 52 forming a seal to define two fluid tight zones within the casing 16.

Once the packer assembly is set, the setting tool 24 must be released therefrom and retrieved or removed from the casing 16. In order to accomplish this, the tubing string 20 is again rotated in a right-hand direction. However, during the second rotation of the drill string 20, the packer assembly 28 is set and cannot turn, and thus the shear screw 94 between the coupling 90 and the tubular mandrel body 76 is sheared. The right-hand rotation of the setting tool stem 48 is effective to unscrew the left hand threads of the coupling 90 from the upper part of the tubular mandrel body 76. The drill string 20 is then lifted further, in which event the upper shoulder of the coupler 90 engages a lower shoulder of the anchor cage 64, thereby lifting the apparatus attached thereto.

As noted above, the slip-cover sleeve 68 is fixed to the anchor cage 64 and is removed from the casing 16 also. However, should the threaded ring 74 remain engaged by a few threads with the threads 70 of the slip-cover sleeve 68, the complete upward removal of the packer setting tool 24 is prevented. Preferably, the threaded engagement between the slip-cover sleeve 68 and the packer mandrel 76 must be greater in length than the distance the slip-cover sleeve 68 extends over the upper slips 50. Otherwise, it would be possible that the upper slips 50 could not move down and wedge between the upper head 122 and the casing 16. In accordance with an important feature of the invention, the slip-cover sleeve 68 is provided with a number of slits 72 to allow slight radial outward deformation thereof. Thus, with an upward movement of the slip-cover sleeve 68, a central section thereof is flexed outwardly by the engagement with the threaded ring 74, whereby the sleeve threads 70 slip over the threads 78 of the ring 74, and the parts are separated. The tapered threads of both the threaded ring 74 and slip-cover sleeve 68 facilitate the forced disengagement therebetween. It can be appreciated that the threads are not sheared or stripped, as it would require an enormous force for such action. After the slip-cover sleeve 68 is completely separated from its threaded engagement with the threaded ring 74, further upward movement of the drill string 20 is effective to remove the packer setting tool 24, the friction spring anchor assembly 26, the slip-cover sleeve 68 and the central conduit 77 from the well bore.

Figure 4:
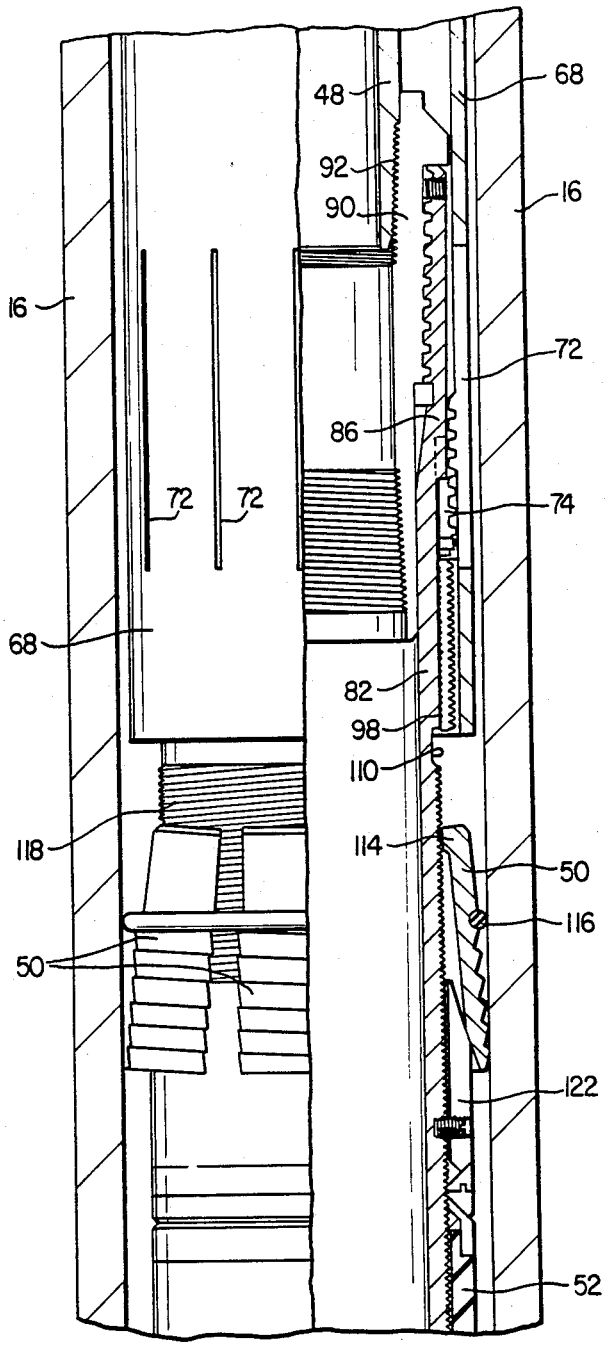
FIG. 4 is a partial sectional view of the packer assembly located within a casing, just before removal of the setting tool before the upper slips are fully set.

FIG. 4 illustrates an enlarged section of FIG. 2*c*, particularly the relationship of the packer parts after deployment of the upper slips 50, and in the event a threaded engagement still exists between the slip-cover sleeve 68 and the threaded ring 74. The illustration depicts the upper slips 50 before they are forced into a full gripping set with the casing 16. Further rotational movement of the setting tool stem 48 is ineffective to rotate the threaded ring 74 with respect to the slip-cover sleeve 68, as the second upward movement of the drill string 20 causes the mandrel lug 84 to be completely removed upwardly out of the notch 80 of the threaded ring 74.

While the packer setting tool 24 and the packer assembly 28 itself can be utilized for isolating zones within a well casing 16, such apparatus is also well adapted for the installation of a well bore liner. A fiberglass liner can be attached to the packer assembly 28 and set within the bottom of a well bore with cement. The technical advantage of utilizing a packer seal together with a cemented well bore annulus is that a high degree of strength and a high quality fluid seal is provided within the casing.

Figures 5A, 5B:
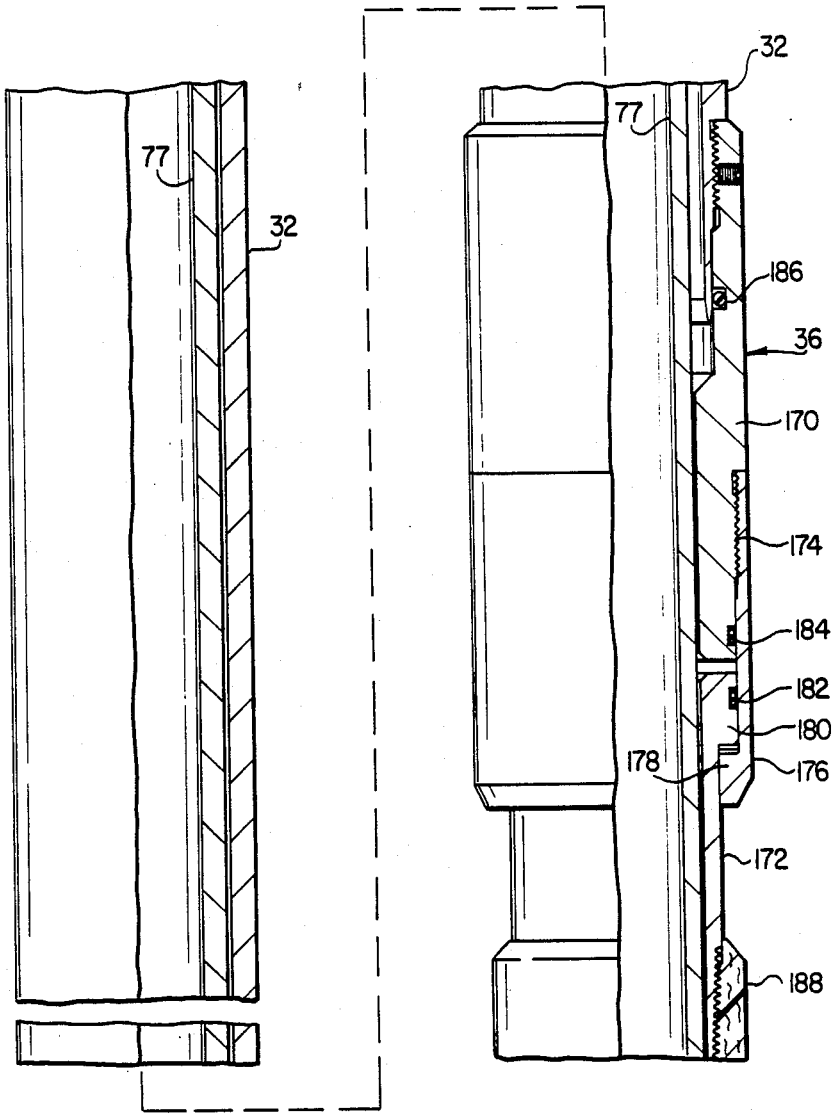
FIGS. 5*a*–5*e*, when joined together, are partial cross-sectional views of the packer setting tool and assembly, together with the well bore liner installing apparatus.

As illustrated in FIG. 5*a*, the central conduit 77 extends through the upper seal bore extension 32. The central conduit 77 may be of a general length with a lower end which terminates below within the lower seal bore 38.

A swivel 36 is connected to the bottom of the seal bore extension 32 for allowing the apparatus connected thereabove to rotate, without requiring the equipment therebelow to also rotate. In particular, the swivel 36 allows the packer assembly 28 and associated equipment to be rotated for releasing the upper slips 50, as well as to be subsequently rotated to release the setting tool from the packer assembly 28. The swivel 36 allows the noted equipment to be rotated during the initial packer setting steps, without rotating the equipment below the swivel 36, which is surrounding with liquid cement, and which would cause an unnecessary drag to the drill string 20. Conventional swivels are available for the noted use. The illustrated swivel 36 is constructed with a cylindrical housing 170 having an upper threaded end connected to the bottom of the seal bore extension 32. The bottom of the swivel 36 abuts with a tubular stub 172, each with similar diameter bores. The swivel housing 36 has lower threads 174 matable with the threads of a swivel collar 176. The collar 176 has a shouldered end 178 which cooperates with a flange 180 on the stub 172 for clamping the parts together, although not tightly, as the threaded end of the collar 176 bottoms out in the swivel housing 170. As a result, the swivel 36 can rotate with respect to the stub 172. O-rings 182 and 184 provide a fluid seal between the swivel housing 170 and the stub 172. An additional O-ring 186 seals the seal bore extension 32 to the swivel 36.

A fiberglass or other similar type of well bore liner 34 is connected to the swivel 36 by an internally threaded coupler 188. The coupler 188 is preferably constructed of fiberglass for interfacing a fiberglass liner 34 to the steel swivel stub 172. The fiberglass liner 34 may be as long as necessary to satisfy particular applications. In practice, the liner 34 may be 300–600 foot long to assure that the entire depth of an oil producing formation 14 can be lined with the liner 34. Indeed, the invention may include one or more sections of the liner 34 to accommodate one or more distinct oil producing formations which are vertically separated. In the example, a single fiberglass liner 34 is illustrated.

Figures 5C, 5D:
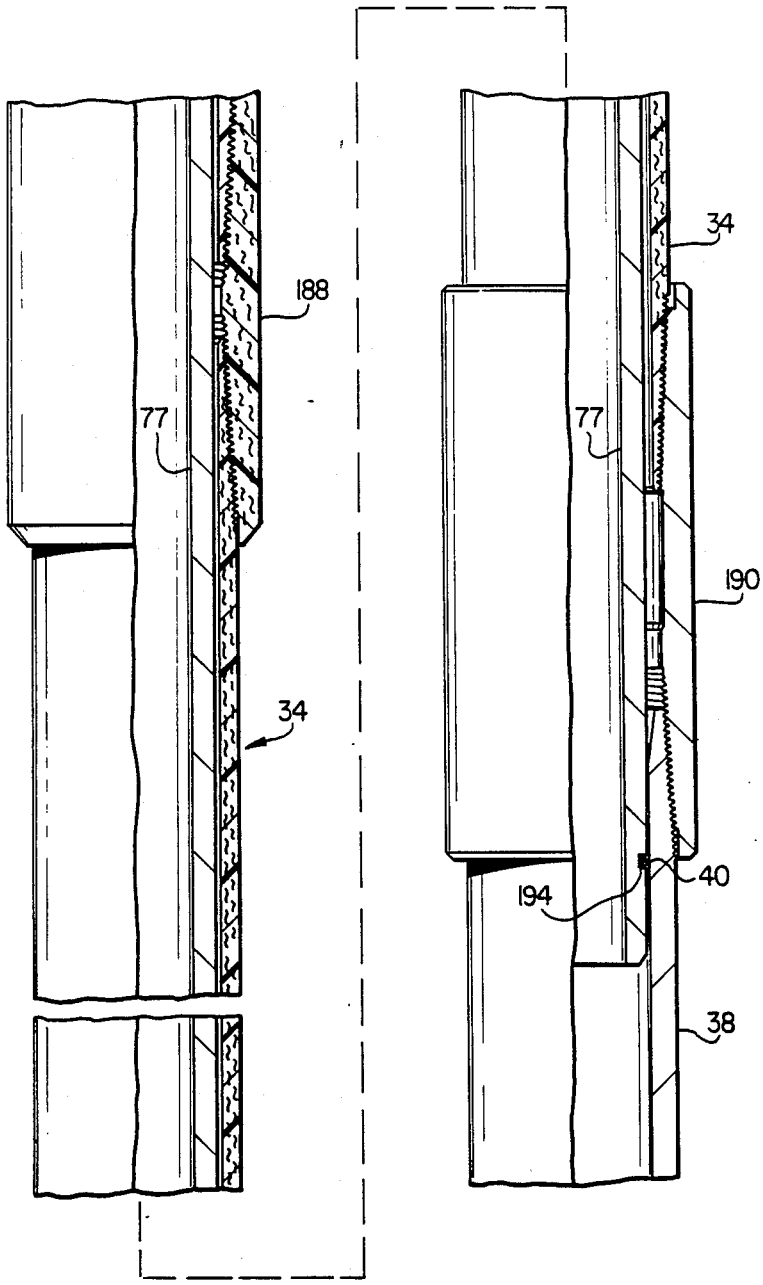
Figure 5E:
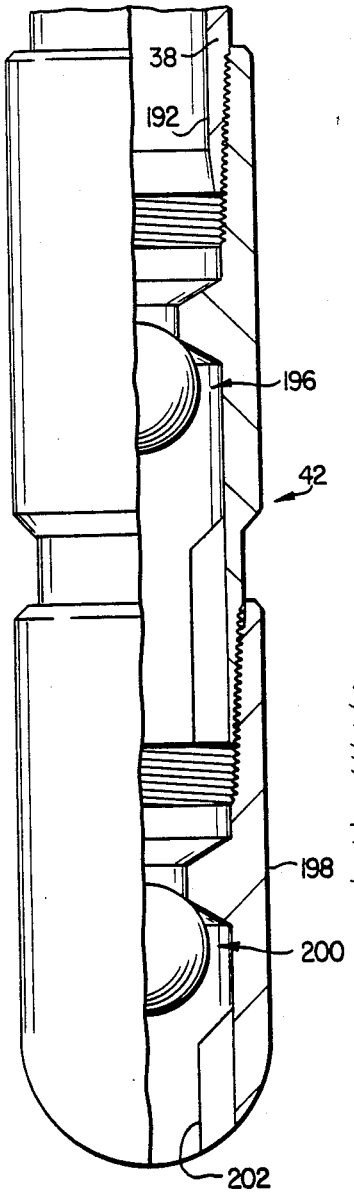

A lower seal bore 38 is threadably connected to the fiberglass liner 34 by an internally threaded coupling 190. The coupling 190 is adapted for connecting fiberglass tubulars to steel tubulars, from which the lower seal bore 38 is constructed. The lower seal bore 38 terminates with a threaded end 192 which is connectable to a check valve assembly 42. As noted above, the central conduit 77 terminates within the lower seal bore 38. As noted in FIG. 5d, the lower end of the central conduit has formed therein an outer annular groove 194 with an O-ring seal 40 disposed therein. The seal 40 seals the central conduit 77 to the lower seal bore 38 to prevent cement and other liquid from entering the space between such tubular elements. When the drill string 20 is withdrawn from the casing 16, the central conduit 77 is removed also.

The check valve assembly 42 of FIG. **5*e* is of conventional design, preferably of the ball and seat type. The check valve 42 prevents the backflow of the liquefied cement back up the central conduit 77. Connected to the lower end of the upper check valve 196 is a float shoe 198, which also carries within it a second lower check valve 200. The second check valve 200 is redundant in nature, assuring that the liquefied cement will not flow backwardly up the tubular structure if the upper valve sticks or fails. The end of the float shoe 198 includes an exit port 202 for allowing liquefied cement pumped down the tubular structure to enter the well bore 10 and flow upwardly in the annulus. As noted above, the annulus is defined as space between the described tubular structure and the well casing 16,.and/or the well bore 10** itself.

Figure 6:
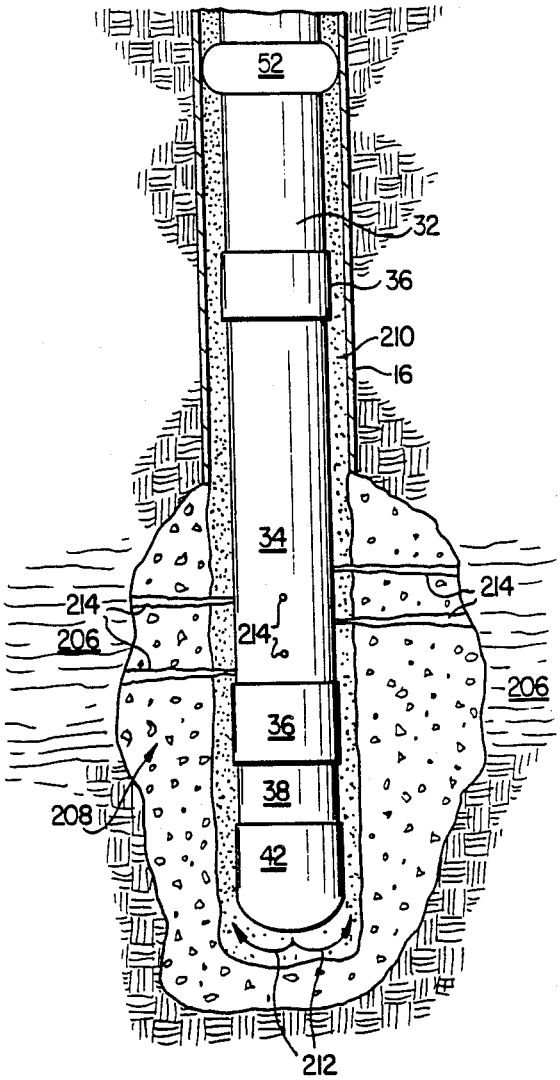
FIG. 6 is a side elevational view of the liner installing equipment of the invention as employed in one application.

In an important application of the invention shown in FIG. 6, the fiberglass liner 34 is utilized to provide a pseudo-casing where casing materials have either been completed eroded, or where no casing exists, such as the bottom of an existing well. In the example of FIG. 6, the casing 16 is shown terminated above the location where the fiberglass liner 34 has been lowered into the well bore 10. Shown also is a hydrocarbon formation 206 which is located below the casing 16, and which is depicted as being plugged by a material 208. A conventional practice in plugging depleted hydrocarbon formations is the use of a composition 208 comprising pea-gravel held together by a congealed gel substance. As noted in FIG. 6, the well has been re-drilled to remove a portion of the blocking material 208, and the described tubular structure has been lowered into the bottom of the resulting well bore.

The invention can be advantageously employed in reopening previously depleted and plugged hydrocarbon formations 206, and utilize such formations to inject fluids therein to increase the hydrocarbon production at other wells connected to the formation, and from which hydrocarbons are extracted. In other words, liquids, such as water, or gases such as carbon dioxide, can be injected into the depleted formation 206 to force tertiary oil deposits within the formation toward other hydrocarbon producing wells (not shown). By utilizing existing depleted wells or formations for injection purposes, major expenses and labor costs can be avoided in drilling new wells down to the formation to inject fluids therein.

To accomplish the foregoing, the tubular structure is lowered into the well to the position indicated such that the fiberglass liner 34 is situated adjacent the hydrocarbon formation 206. Next, a liquefied cement 210, or other setting or hardening agent, is pumped down the drill string 20, through the packer setting stem 48, the central conduit 77 and out the exit port 202 of the float shoe 198. The liquefied cement then flows upwardly, as indicated by arrows 212 into the annulus of the well bore. It is preferable to pump sufficient cement down the tubular structure in order for the annulus flow thereof to rise above the level of the packer assembly 28. The general volume constraints of the annulus and the bottom of the well bore are known, and thus a calculated volume of cement can be pumped downhole, followed by a different liquid which does not readily mixed with the cement. Hence, the central part of the tubular structure can be substantially cleared of the cement material, before hardening thereof. The annulus of the well bore is preferably generally the only area containing the cement.

After removal of the packer setting equipment as described above, and after the cement 210 has hardened, casing firing apparatus (not shown) can be lowered into the tubular structure to a location adjacent the lining 34. The firing apparatus can be actuated to perforate the liner 34 with a number of holes 214. The force of the perforator is also effective to perforate the cement 210 as well as the blocking material 208. A plurality of fluid communicating channels is thereby formed between the depleted formation 206 and the internal part of the tubular structure fixed within the casing 16.

Extremely high pressure liquids or gases can then be pumped downhole by surface equipment to flood the depleted formation 206 and force any residual hydrocarbon deposits to remote production wells. In accordance with an important technical advantage of the invention, the packer sealed in cement to the casing provides an ideal fluid seal such that all the fluid pumped down hole is utilized to flush the formation, and substantially no fluid leaks through the cement interfacing with either the casing or the tubular structure. This can be appreciated in that the cement shrinks during curing and may even crack after a period of time, thereby otherwise providing an uphole escape route for the fluid. In addition, the elastomeric packer seal is more effective to seal old rusty or corroded casings than possible with cement alone and many commonly used hardening agents.

From the foregoing, it can be seen that an improved packer setting tool is disclosed for quickly and efficiently setting a packer assembly and associated liner assembly, as well as for reliably and effectively being removed therefrom. While the preferred embodiment of the invention has been disclosed with reference to a specific apparatus and application, it is to be understood that many changes in detail may be made as a matter of engineering choices without departing from the spirit and scope of the invention, as defined by the appended claims.

What is claimed is:

1. Apparatus for installing a liner in a well bore, comprising:

a packer assembly adapted for expansion within the well bore to seal the well bore;

a swivel connected to packer assembly;

a well bore liner attached to said packer assembly by said swivel to permit rotation of a portion of said packer assembly without rotating said liner;

a packer setting assembly for setting the packer within the well bore and adapted for separation from the packer assembly; and a central conduit extending through and sealed to said apparatus below said packer assembly, and through which a hardening agent is conducted for cementing the liner within the well bore.

2. The liner installing apparatus of claim 1, further including a seal bore tubular connected to the liner, said seal bore tubular being sealed to said central conduit.

3. The liner installing apparatus of claim 2, further including a check valve fixed below said liner to allow a one-way flow of cement through said liner.

* * * * *

UNITED STATES PATENT AND TRADEMARK OFFICE

CERTIFICATE OF CORRECTION

PATENT NO. : 4,848,459

DATED : July 18, 1989

INVENTOR(S) : Henry W. Blackwell, et al.

It is certified that error appears in the above-identified patent and that said Letters Patent is hereby corrected as shown below:

Title page, item [75],

Inventors: Henry W. Blackwell, Venus, Texas.;
Clifford L. Talley, Hobbs, N. Mex.;
Rodger D. Lacy, Midland, Tex.;
Peter D. Bowser, Hobbs, N. Mex.;
Carey D. K. Darr, Casper, Wyo.

Signed and Sealed this

Thirteenth Day of July, 1993

*Attest:*

Michael K. Kirk

MICHAEL K. KIRK

*Attesting Officer*

*Acting Commissioner of Patents and Trademarks*